US010030935B1

(12) United States Patent
Ding et al.

(10) Patent No.: US 10,030,935 B1
(45) Date of Patent: Jul. 24, 2018

(54) SELECTIVELY CONFIGURABLE FIREARM SIGHT

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 15/871,720

(22) Filed: Jan. 15, 2018

(51) Int. Cl.
*F41G 1/17* (2006.01)
*F41G 11/00* (2006.01)

(52) U.S. Cl.
CPC ..... *F41G 1/17* (2013.01); *F41G 11/00* (2013.01)

(58) Field of Classification Search
CPC ..... F41G 11/00; F41G 1/06; F41G 1/17
USPC ..... 42/148, 138, 140
See application file for complete search history.

(56) References Cited

U.S. PATENT DOCUMENTS

| | | | |
|---|---|---|---|
| D494,471 | S | 8/2004 | Chou |
| D505,328 | S | 5/2005 | Chou |
| D510,120 | S | 9/2005 | Ding |
| D511,365 | S | 11/2005 | Ding |
| D513,056 | S | 12/2005 | Ding |
| D513,298 | S | 12/2005 | Ding |
| D513,299 | S | 12/2005 | Ding |
| D513,633 | S | 1/2006 | Ding |
| D516,157 | S | 2/2006 | Ding |
| D594,084 | S | 6/2009 | Mayberry et al. |
| D638,089 | S | 5/2011 | Ding |
| D639,376 | S | 6/2011 | Ding |
| D641,450 | S | 7/2011 | Ding |
| D648,413 | S | 11/2011 | Mayberry et al. |
| D649,993 | S | 12/2011 | Ding |
| D654,552 | S | 2/2012 | Wu et al. |
| D659,221 | S | 5/2012 | Wu et al. |

(Continued)

FOREIGN PATENT DOCUMENTS

| | | |
|---|---|---|
| EP | 2520894 A1 | 7/2012 |
| WO | 2013082274 A1 | 6/2013 |

OTHER PUBLICATIONS

Leapers, Inc. UTG 400 Luman Everyday Defense LED L-light downloaded from https://www.leapers.com/index.php?act=prod_detail&midx=988&allids=988&itemno=LT-EL223HL-A on Nov. 27, 2017.

(Continued)

*Primary Examiner* — Reginald S Tillman, Jr.
(74) *Attorney, Agent, or Firm* — Warner Norcross + Judd, LLP

(57) ABSTRACT

A firearm sight, optionally having a 45° offset mount, including a sight element selectively configurable in upright position and down positions, and a moveable plunger configurable in a locking mode in which a head of the plunger protrudes from it such that upon rotation of the sight element about a pivot axis, the head engages a plunger wall of the mount to arrest such rotation to thereby maintain the sight element substantially in the upright position, the plunger alternatively configurable in a free mode in which the head is retracted into the sight element so the head clears the plunger wall and the sight element can move to the down position. The mount can include an extension stop wall adjacent the head so the head cannot be deployed from the sight element to maintain it in the down position. The plunger can be actuated ambidextrously. A related method is provided.

20 Claims, 8 Drawing Sheets

(56) References Cited

U.S. PATENT DOCUMENTS

| | | | | |
|---|---|---|---|---|
| D672,839 | S | 12/2012 | Ding | |
| 8,397,421 | B2 | 3/2013 | Ding et al. | |
| 8,429,843 | B2 | 4/2013 | Yan | |
| 8,437,079 | B2 | 5/2013 | Wu | |
| 8,490,315 | B2 * | 7/2013 | Dueck | F41G 1/02 42/111 |
| D692,516 | S | 10/2013 | Yan et al. | |
| D705,890 | S | 5/2014 | Fitzpatrick et al. | |
| 8,752,325 | B2 | 6/2014 | Ding et al. | |
| D711,492 | S | 8/2014 | Yan et al. | |
| 8,806,792 | B2 | 8/2014 | Yan et al. | |
| 8,984,797 | B2 * | 3/2015 | Ballard | F41G 1/00 42/111 |
| D726,278 | S | 4/2015 | Ding et al. | |
| D727,455 | S | 4/2015 | Ding et al. | |
| D728,728 | S | 5/2015 | Barfoot et al. | |
| D730,474 | S | 5/2015 | Ding et al. | |
| 9,169,958 | B2 | 10/2015 | Yan | |
| D751,663 | S | 3/2016 | Ding et al. | |
| 9,322,615 | B2 * | 4/2016 | Raybman | F41G 1/17 |
| D755,342 | S | 5/2016 | Ding et al. | |
| D758,521 | S | 6/2016 | Ding et al. | |
| D758,522 | S | 6/2016 | Ding et al. | |
| D771,218 | S | 11/2016 | Ding et al. | |
| D773,005 | S | 11/2016 | Ding et al. | |
| 2006/0075674 | A1 | 4/2006 | Ding | |
| 2007/0277422 | A1 | 12/2007 | Ding | |
| 2012/0102803 | A1 * | 5/2012 | Troy | F41C 23/16 42/71.01 |
| 2012/0281278 | A1 | 11/2012 | Wu | |
| 2014/0150324 | A1 * | 6/2014 | Keng | F41G 11/003 42/118 |
| 2015/0369564 | A1 * | 12/2015 | Wilson | F41G 11/003 42/111 |
| 2016/0102941 | A1 * | 4/2016 | Brucker | F41G 1/17 42/148 |
| 2016/0209166 | A1 * | 7/2016 | Larson, Jr. | F41G 11/003 |

OTHER PUBLICATIONS

Leapers, Inc. UTG New Gen 400 Lumen Compact Grip Light with QD Mount downloaded from https://www.leapers.com/index.php?act=prod_detail&midx=988&allids=988&itemno=MNT-EL223GPQ-A on Nov. 27, 2017.

Leapers, Inc. UTG New Gen 400 Lumen Grip Light with QD Mounting Base downloaded from https://www.leapers.com/index.php?act=prod_detail&midx=988&allids=988&itemno=MNT-EL228GPQ-A on Nov. 27, 2017.

Leapers, Inc. UTG Flashlights and Lasers downloaded from https://www.leapers.com/index.php?act=listproduct&midx=988&allids=988&svroot=MOUNTING%20SYSTEMS on Nov. 27, 2017.

Leapers, Inc. UTG Mounting Systems downloaded from https://www.leapers.com/index.php?act=listproduct&midx=923&allids=918_919_923&svroot=MOUNTING%20SYSTEMS on Nov. 27, 2017.

Leapers, Inc. UTG 4.1" Lowpro Combat Quality QD Lever Mount Metal Foregrip downloaded from https://www.leapers.com/index.php?act=prod_detail&itemno=MNT-GRP001SQ&midx=1002&allids=1001_1002 on Nov. 27, 2017.

Leapers, Inc. UTG Model 4 Low Profile Flip-up Front Sight MNT-755 dowloaded from https://www.tacticalwholesalers.com/Leapers-Inc-Model-4-Low-Profile-Flip-up-Front-Sight-MNT-755_p_143421.html?gclid=EAlalQobChMIIYywtYT21wIVB57ACh1IDwmuEAYYAyA-BEgKbX_D_BwE on Dec. 6, 2017.

Magpul, MBUS Front & Rear Sight Set downloaded from http://www.tomstactical.com/Magpul-MBUS-Gen-II-Front-Rear-Sight-Set-Black_p_74.html on Jan. 5, 2018.

LWRC International, LWRCI Skirmish Sight Set downloaded from https://www.lwrci.com/p-451-day-9-lwrci-skirmish-sight-set.aspx on Jan. 5, 2018.

Diamondhead, Polymer Diamond Integrated Sighting System (with NiteBrite) downloaded from https://www.diamondhead-usa.com/products/polymer-diamond-integrated-sighting-system-with-nitebrite on Jan. 5, 2018.

Precision Reflex Inc., Flip up Front and Rear Sight Package downloaded from https://www.lapolicegear.com/preflex-flip-up-sight-combo.html on Jan. 5, 2018.

Magpul, MBUS Pro Offset Sight—Front downloaded from https://www.magpul.com/products/mbus-pro-offset-sight-front on Jan. 5, 2018.

Troy Industries, Offset Sight Set, M4 Front and Dioptic Rear—FDE downloaded from https://troyind.com/products/offset-sight-set-m4-front-and-dioptic-rear-fde on Jan. 5, 2018.

HQ Issue, HQ Issue 45° Offset Sight Set downloaded from https://www.sportsmansguide.com/product/index/hq-issue-45deg-offset-sight-set?a=1781389 on Jan. 5, 2018.

Dagger Defense, Dagger Defense flip up BUIS 45 degree picatinny rail mounted backup iron sights downloaded from https://daggerdefense.com/?product=dagger-defense-flip-buis-45-degree-picatinny-rail-mounted-backup-iron-sights on Jan. 5, 2018.

* cited by examiner

SELECTIVELY CONFIGURABLE FIREARM SIGHT

BACKGROUND OF THE INVENTION

The present invention relates to firearms, and more particularly to a firearm sight configurable in deployed and stowed positions.

Firearms can come in various shapes and sizes, and can be configured in various ways for different purposes. Many firearms are outfitted with a primary sighting system to assist a user in aligning the barrel of the firearm with a target so that a bullet fired from the firearm has a high probability of impacting the target at a desired location. Sometimes, a firearm is set up with a primary sighting system consisting of rudimentary fixed position iron sights, which include a rear sight at the rear of the firearm and a front sight over the barrel of the firearm near its muzzle. This system is configured so that the user can align the front and rear sights with one another and a target to aim the firearm. In other cases, the firearm can be outfitted with an optical sight to be used as a primary sighting system. The optical sight can provide magnification to assist a user in aligning the firearm with a target at significant distances.

Until recently, the above systems typically were mutually exclusive, that is, firearms and other weapons were set up with either the iron sights or an optical sight as the primary sight system. The main reason for this was because the two systems usually occupied the same location of the rifle, that is, the top of the firearm. This prevented both from being used simultaneously or under different circumstances because one system would obstruct the other. This mutual location and obstruction issue was addressed with the advent of the 45° offset iron sight. This sight offsets the sights 45° relative to the top of the rifle. With this construction, the iron sight is set off to the side of the top of the rifle. Thus, an optical sight can be placed on the top of the firearm and secondary or back-up offset iron sights can be offset to the side of the optical sight. A user can then selectively utilize either the optical sight or the iron sights on the firearm. For example, the user can hold the firearm upright and use the optical sight to view and engage a target at a long distance. When the user encounters another target at a close distance, and does not desire or need the magnification of the optical sight, the user can rotate the firearm 45°, align the offset iron sights with the target, and engage it.

While dedicated 45° offset sights enable the use of optical sights and iron sights, they suffer some shortcomings. For example, some of these sights are permanently fixed in an upright position. In this case, the optical sight projects up from the top of the firearm, and the offset sights project from the side of the firearm. With all these elements protruding from the firearm in different locations, the likelihood of the firearm snagging or catching clothing, other gear or structures increases. This can be disadvantageous in shooting competitions, training and firefights. Others of these offset sights come in a folding configuration so that the iron sights easily pivot about an axis from the upright position to a down position and vice versa. While helpful in some situations to prevent snagging, these folding sights can become inadvertently folded to the down position, which can be disadvantageous if the user needs the sight upright and it is not there during target engagement.

Accordingly, there remains room for improvement in the field of offset sights configured for firearms.

SUMMARY OF THE INVENTION

A configurable sight for a firearm is provided including a selectively moveable plunger that can prevent a sight element from collapsing from an upright position to a down position.

In one embodiment, the sight is a 45° offset sight that is usable in conjunction with an optical sight. The offset sight can include a mounting portion and an offset portion. The mounting portion can mount to the firearm, for example, to a rail associated with the firearm. The offset portion can extend at an angle relative to the mounting portion to place a sight element in a different line of sight than the optical sight so that a user can select either the offset sight or the optical sight to aim the firearm at a target. Optionally, the user can rotate the firearm a preselected amount, for example 45°, about an axis of a barrel of the firearm while aiming with the offset sight.

In another embodiment, the sight element is pivotally or movably mounted to the offset portion. The sight element can be selectively configured in one of two main positions, that is, an upright position and a down position. In the upright position, the sight element can expose a sight window and/or sight unit that the user can align with a target and another sight on the firearm. In the down position, the sight element can be stored in a relatively low profile configuration so as to prevent it from snagging or catching on clothing and other objects.

In still another embodiment, the sight element can include the plunger movably mounted relative to it. The plunger can include a head that can be deployed from a side of the sight element. When deployed, the head can be positioned along a side and/or project from the side of the sight element such that it engages a plunger wall on the offset portion when the sight element is moved from an upright position toward a down position. When it engages the plunger wall, the head arrests movement of the sight element so that it cannot be moved to the down position and/or optionally is urged back to the upright position.

In even another embodiment, the plunger can include a polygonal shaped head with an engagement surface also referred to as a head locking surface. The engagement surface can be generally flat. The engagement surface can engage another generally flat surface of the plunger wall so that the sight element is prevented from pivoting substantially. In operation, the plunger head engages or collides with the plunger wall to arrest or prevent rotation of the sight element. In some cases, the polygonal head can be rectangular, and can deploy from a similarly shaped recess defined by a side surface of the sight element.

In a further embodiment, the base can include an extension stop wall. The extension stop wall can be positioned on the mounting portion, adjacent a location where the sight element rests when in the down position. The extension stop wall can extend adjacent an end of the plunger, and in particular the head of the plunger. The extension stop wall can partially or fully obstruct the head, thereby preventing it from being deployed from the sight element when the sight element is in the down position. This can prevent inadvertent deployment of the plunger and subsequent locking of the sight element in the down position.

In still a further embodiment, the plunger can include a button on an opposing end of the plunger relative to the head. The button can be depressed and/or pulled to deploy and/or retract the plunger from a locking mode to a free mode. The head also can be manually accessible and manipulated to convert the plunger from the locking mode to the free mode. With the construction, the plunger locking mechanism can be ambidextrously actuated by a user.

In even a further embodiment, the plunger can include one or more detents along a shaft of the plunger. The detents can accommodate one or more corresponding balls that are urged or biased toward the shaft, and thus engage the detents. One detent can be positioned along the shaft so that when engaged by the ball, the plunger is locked in the locking mode to maintain the sight element in the upright position. Another detent can be position closer to the head so that when the shaft is moved and engages the ball, the detent and ball engagement holds the plunger in the free mode with the head un-deployed from the side of the sight element.

In yet a further embodiment, the sight can be outfitted with a bias element, and the sight element can include different contours in different locations. For example, the bias element can engage a first contour on a lower surface of the sight element to hold the sight element in the upright position. When the bias element is overcome via a user applying force to urge the sight from the upright position to the down position, the second contour can eventually be engaged by the bias element, in which case these elements maintain the sight element in the down position.

In another embodiment, the bias element can include a leaf spring associated with the offset portion under the sight element and a pivot axis of the sight element.

In still another embodiment, a method is provided. The method can include providing a base including a mounting portion mountable on a firearm rail, and an offset portion integral with and tilted downward at an angle of about 45° relative to the mounting portion, the offset portion including a plunger wall and an extension stop wall; sliding a plunger in a first direction in a plunger bore defined by a sight element, the plunger including a first end and a second distal end, the second distal end including a head, so as to configure the plunger in a locking mode in which the head protrudes from the sight element such that upon rotation of the sight element about a pivot axis, the head engages the plunger wall to arrest such rotation to thereby maintain the sight element substantially in the upright position; sliding the plunger in a second direction, opposite the first direction, in the plunger bore so as to configure the plunger in a free mode in which the head is retracted into the sight element so the head clears the plunger wall and the sight element can move to the down position, wherein the extension stop wall is adjacent the head in the down position so that it obstructs movement of the head and the head cannot be deployed from the second side surface to maintain the sight element in the down position when the sight element is in the down position.

The current embodiments of the firearm sight and related method of use provide benefits above that previously have been unachievable. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
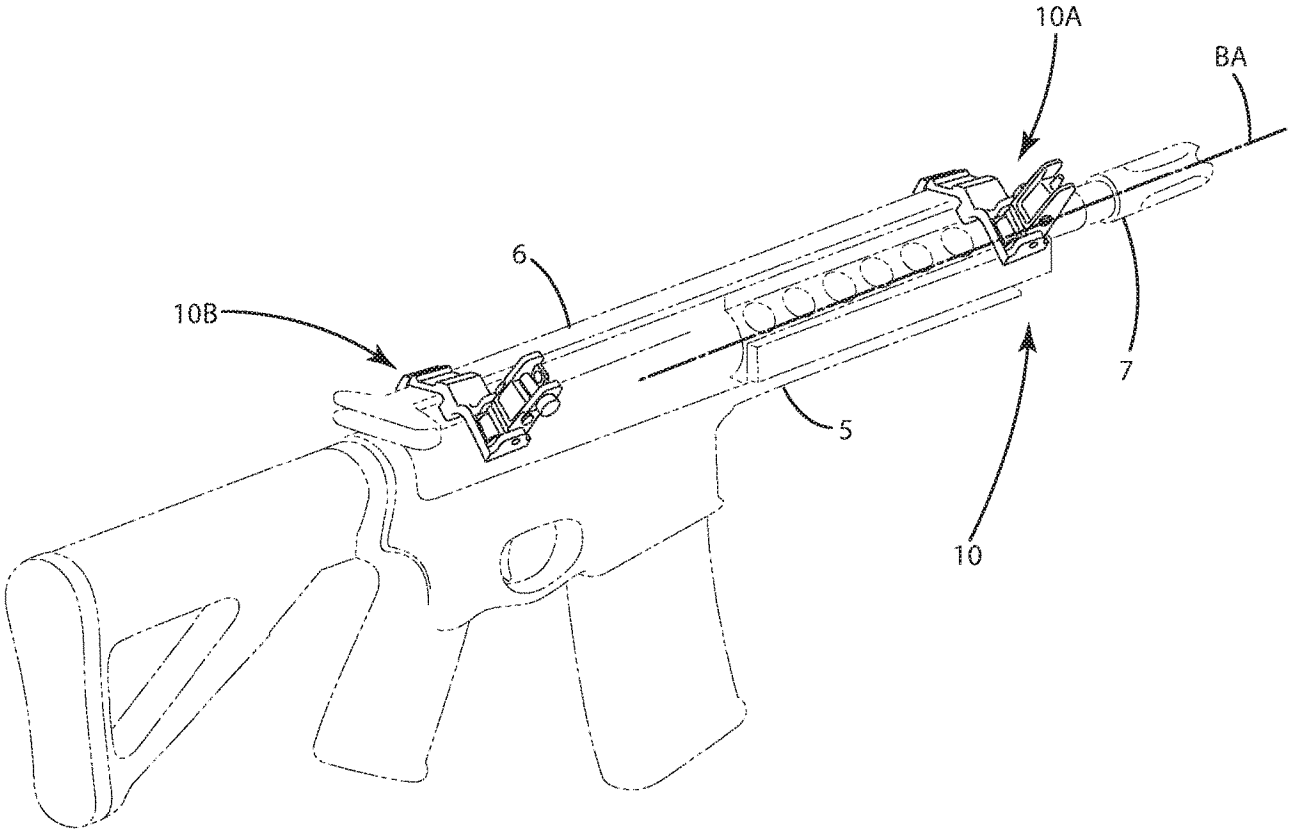
FIG. 1 is a rear perspective view of a firearm with selectively configurable sights of a current embodiment in an upright position.

A selectively configurable sight for a firearm of the current embodiment is illustrated in FIGS. 1-8 and generally designated 10. The selectively configurable sight 10 can be implemented as front or rear sights, optionally including windage and/or elevation adjustment mechanisms. As illustrated in FIG. 1, the sight 10 can be in the form of a front sight 10A and/or a rear sight 10B, mounted along a rail 6 of the modern sporting rifle 5. The sight 10 can be utilized with any type of firearm or weapon. As described herein, the sight 10 is a front sight, but again, the current embodiments can be utilized in connection with a rear sight. Further, the sight 10 can be used with firearms, such as rifles, shotguns, handguns, artillery weapons, as well as archery equipment, such as compound bows and crossbows, or other projectile shooting devices.

Figure 2:
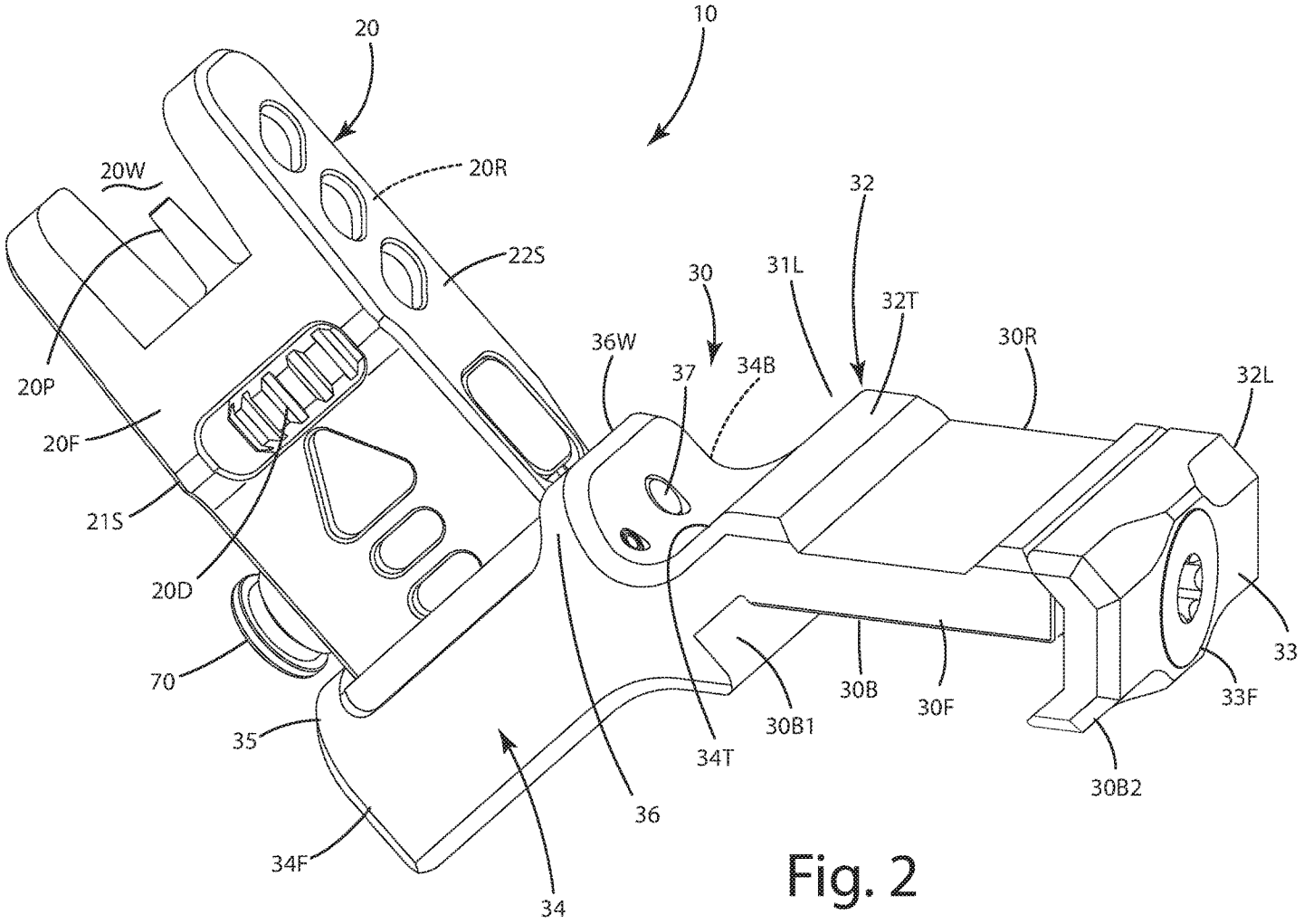
FIG. 2 is a front perspective view of a front firearm sight in an upright position, and a plunger in a free mode.

With reference to FIG. 2, the sight 10 can include a sight element 20. The sight element 20 can include a front surface 20F, a rear surface 20R a first side surface 21S and a second side surface 22S. The front surface 20F can generally face toward the muzzle 7 of the firearm 5 to which the sight 10 can be joined. The sight element can define a sight window 20W that extends through the sight element, from the front surface 20F to the rear surface 20R, generally between the first side surface 21S second side surface 22S. Within the sight window 20W, a sight post 20P can be located. This sight post 20P can be configured so that upon rotation of the sight disk 20D to which the post 20 is attached, the sight post extends farther upward or downward, to alter a point of aim of the sight 10. In comparing FIGS. 2 and 5, the sight element 20 is selectively configurable in an upright position, shown in FIG. 2, and a down position, shown in FIG. 5. In converting to and from upright and down positions, the sight element 20 pivots about the longitudinal axis LA, and generally about a pivot pin or axle 37.

The sight element 20 can be joined with a base 30. The base 30 can include a mounting portion 32 that is mountable on or to a firearm. As shown, the mounting portion 32 is configured to be mounted on a firearm rail, for example, a picatinny rail 6 which is common to many modern sporting rifles and firearms. The mounting portion 32 can include a front 30F, a rear 30R a first lateral side 31L and a second lateral side 32L, across from one another. The mounting position 32 can include a bottom 30B. The bottom 30B can be flanked on opposing sides by first and second bottom walls 30B1 and 30B2. Each bottom wall can include a v-shaped notch configured to fit and engage the rail 6. The second bottom wall 30B2 can include a block 33, which defines the notch to accommodate the rail 6. The block 33 can be joined with the remainder of the mounting portion 32 via fastener 33F. The fastener 33F can be threaded into a corresponding hole in the mounting portion 32 so that the block 33 can be clamped against the rail, generally between the first bottom wall 30B1 and the second bottom wall 30B2. In this manner, the sight can be clamped to the rail. Of course, other configurations of the fastener block and the mounting portion 32 can be utilized in conjunction with the current embodiment of the sight 10.

Figure 3:
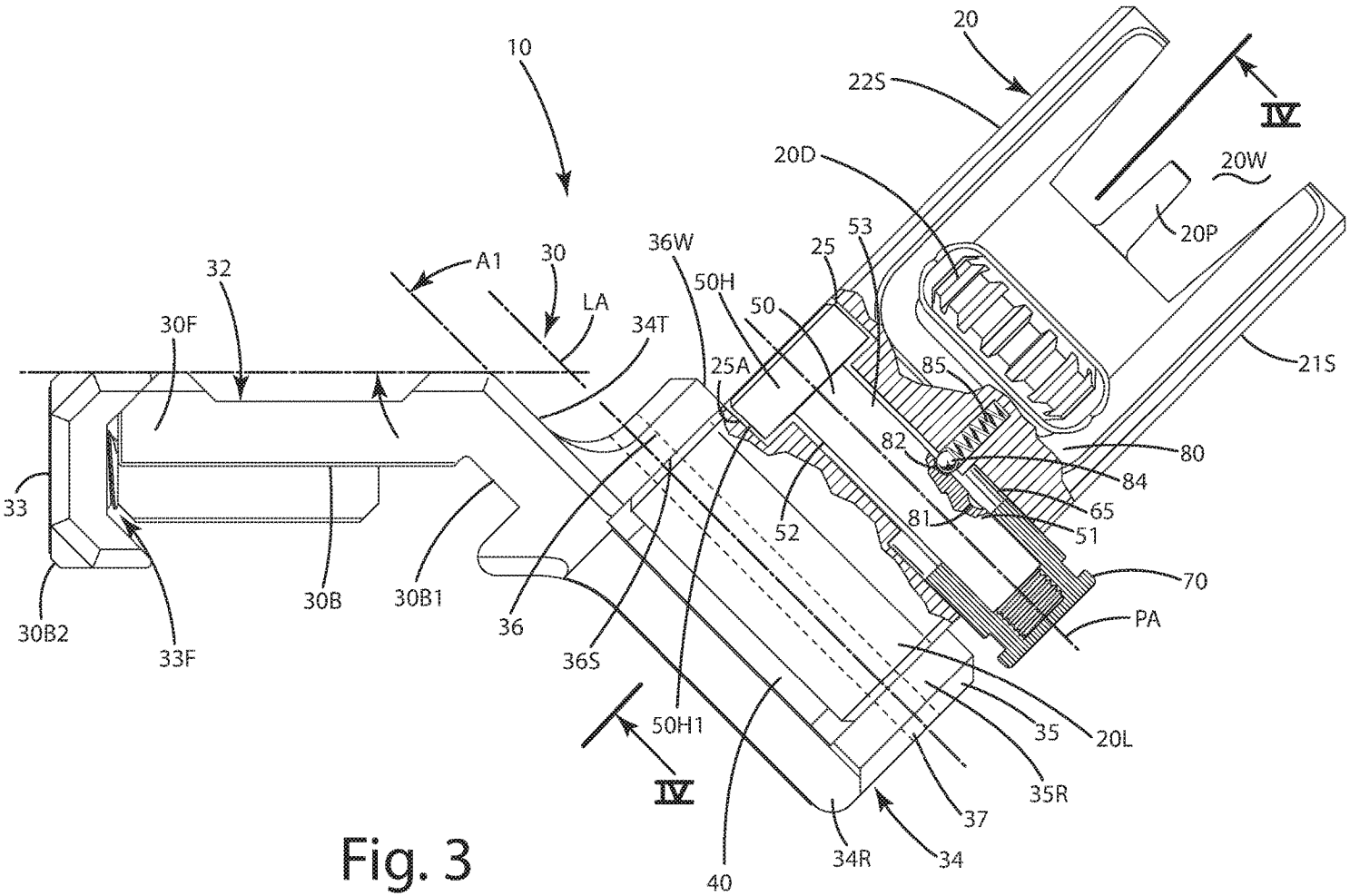
FIG. 3 is a front partial section view of the sight in the upright position, and the plunger in the free mode.

The base 30 can also include an offset portion 34 joined with the mounting portion 32. The offset portion 34 can be angled relative to the mounting portion 32 and angle A1. That angle optionally can be between 35° and 55°, and further optionally 45°. That angle A1 can be measured comparing the top surface 34T of the offset portion 34 to the top surface 32T of the mounting portion 32. The offset portion 34 can include a front surface 34F and a rear surface 34B. The offset portion also can include spaced apart first flange 35 and second flange 36. These first and second upright flanges can extend outwardly from the top surface 34T of the offset portion 34. These upright flanges can be spaced from one another such that the sight element 20, and in particular its lower portion 20L can be nested rotatably between the first and second upright flanges as shown in FIG. 3. Optionally, the first and second upright flanges can be pivotally joined with the sight element 20 via an axle or pivot pin 37. This axle 37 can include the longitudinal axis LA. The sight element 20 can rotate about the longitudinal axis LA to the upright and down positions as described in further detail below.

The offset portion 34 can be configured to retain or otherwise be joined with a bias element 40. The offset portion 34 can include an offset base 34B that defines a recess 34R within which the bias element 40 is at least partially disposed. The recess portion 34R can be bounded at a rear portion thereof via a lip 34L. A portion of the bias element 40 can extend upward to be placed adjacent the lip 34L. The recess 34R can further be bounded by a front wall 34RF. The recess 34R can be bounded by the first and second upright flanges 35 and 36 in some applications.

Figure 4:
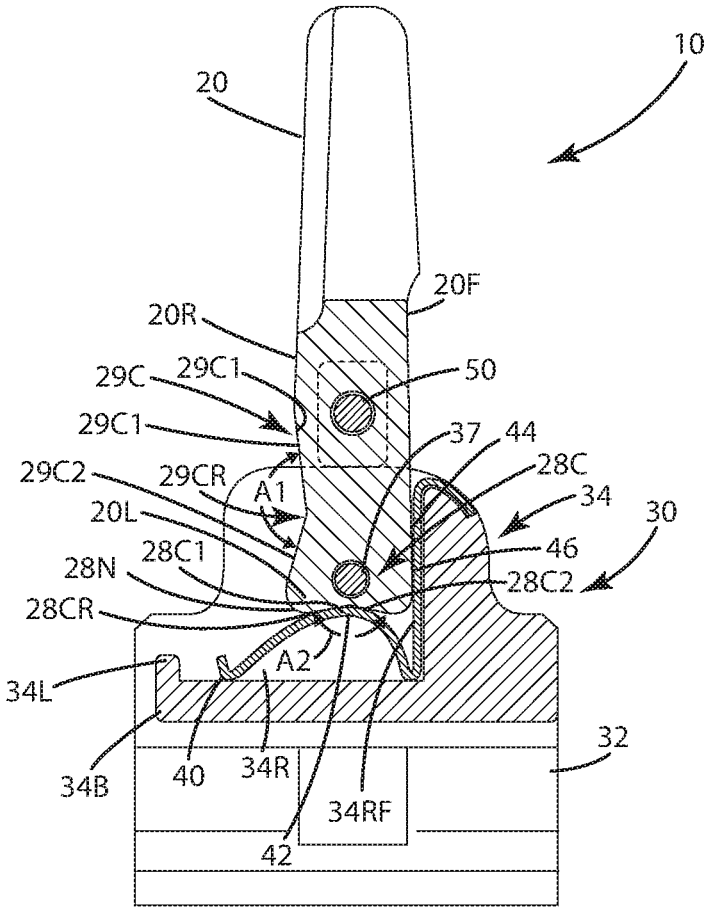
FIG. 4 is a section view of the sight in the upright position taken along line IV-IV of FIG. 3, and the plunger in the free mode.
Figure 6:
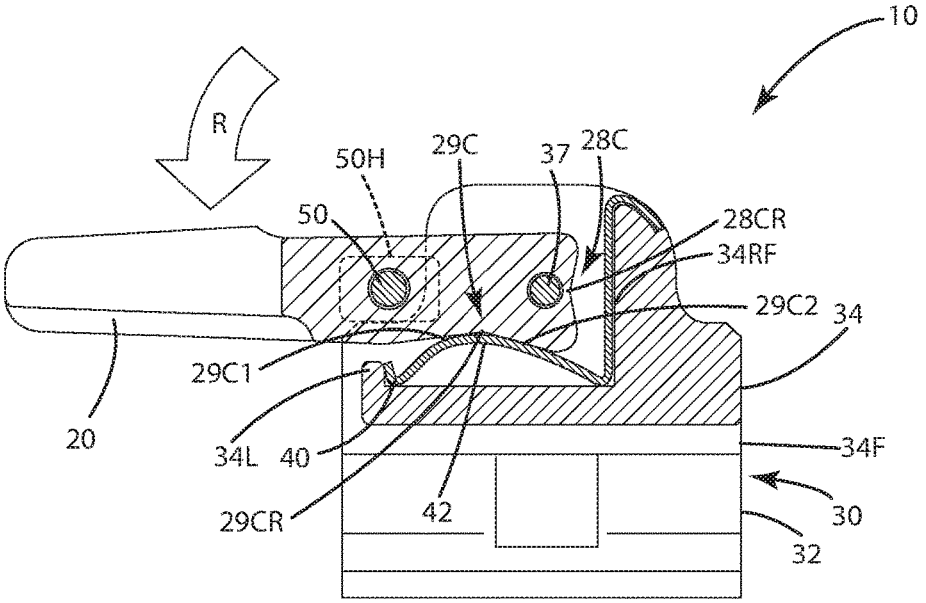
FIG. 6 is a section view of the sight in the down position taken along line VI-VI of FIG. 5.

As shown in FIGS. 4 and 6, the bias element 40 can include a leaf spring 42, or more generally an arched portion. The leaf spring 42 can extend from the lip 34L toward the front wall 34RF. The leaf spring 42 can be configured to engage at least two surfaces of the sight element, depending on the configuration of the sight element, as described in detail below. The leaf spring 42 can be disposed below the axle 37 and the plunger 50 as described further below. The leaf spring 42 can be trapped or located under the sight element 20, between the sight element 20 and the offset portion 34, optionally within the recess 34R. To remove or service the leaf spring, the axle 37 and sight element 20 can be removed.

Optionally, the bias element can be constructed from spring steel or some other resilient, flexible and deformable metal, polymer and/or composite depending on the application.

Turning now to FIGS. 4 and 6, the leaf spring 42 can be configured to engage the sight element, holding that sight element in an upright position as shown in FIG. 4 and/or a down position as shown in FIG. 6. The sight element can be configured to facilitate the holding of the sight element in those positions. In particular, the lower portion 20L of the sight element 20 can include a first contour 28C, and the rear surface 20R can include a second contour 29C. The first contour 28C can include a first recess 28CR. This recess optionally can include first 28C1 and second walls 28C2. Optionally, these walls can be at least partially planar and angled relative to one another as shown. Alternatively, these walls can transition to and/or generally form a rounded and/or arched recess. As illustrated, the first wall 28C1 and second wall 28C2 are offset from one another at an angle A2. This angle A2 can be an obtuse angle. This angle A2 can be optionally greater than 90°, further optionally 90° to 180°, yet further optionally 100° to 160°, even further optionally 130° to 160°, or other obtuse angles, depending on the application. The second recess 29CR also can be bounded by first 29C1 and second 29C2 walls that form the contour 28C. These walls can similarly be at least partially planar and angled at angle A3 relative to one another. This angle A3 can be similar to the obtuse angles identified above in connection with the angle A2 of the first contour 28C. Optionally, this contour 29C can be modified such the walls form a rounded recess configured to engage the bias element 40.

The first and second contours are configured to respectively engage the bias element 40 to hold the sight element 20 in the upright position shown in FIG. 4 or the down position shown in FIG. 6. In FIG. 4, the bias element 40 secures the sight element 20 in the upright position by way of the leaf spring 42 engaging the first wall 28C1 in a first location and a second wall 28C2 in a second location distal from the first location. These two locations can be simple lines of contact between the top surface of the leaf spring 42 and those walls respectively. Optionally, the leaf spring or arched portion 42 can engage the wall 28C1 sufficiently so that the front surface 20F of the sight element 20 is pushed against and engages the upright portion 46 of the bias element 40, thereby holding and pressing the sight element into that position. Due to the spring engaging the first contour, the sight element 20 also can experience a clockwise moment CM (from the view in FIG. 4) about the axle 37. This movement can ensure a constant engagement of the front surface 20F of the sight element 20 with the bias element portion 45, and a consistent return to zero for the sight.

To convert the sight element 22 the down position shown in FIG. 6, without the plunger 50 in a locking mode as described below, a user exerts a rotational force R in a counterclockwise direction about the pivot pin 37. This in turn pushes the node 28N of the lower portion 20L of the sight element 22 downward, compressing the leaf spring 42. When the leaf spring compresses, it disengages the second wall 28C2, slides along the first wall 28C1, and around the node 28N. At that point, the leaf spring 42 begins to engage the second wall 29C2 of the second contour 29C. Due to the angle of the wall and the shape of the contour 29C in general, the leaf spring 42 nests within and engages the contour 29, such that the leaf spring 42 decompresses and expands into the recess 29CR. The leaf spring 42 thereafter pushes against the contour 29C and thereby holds the sight element in the down position shown in FIG. 6.

Optionally, the bias element 40 including the leaf spring 42 can be substituted or replaced with some other bias element, such as a detent mechanism, a ball and spring combination, an elastomeric element, or some other element that can engage the different contours or different portions of the sight element 20 to hold the sight element in the locked position, the down position, or some other position.

In cases where the first and second contours 28C and 29C include planar angled walls, the bias element might only engage those walls along lines of engagement when in the upright or down positions. Further, the respective walls can disengage the bias element 40 one at a time within the contour. For example, in transitioning to the down position, the second wall 28C2 can disengage bias element 40 first, while the first wall 28C1 remains engaged or contacting the bias element during further transition from that position to the down position or vice versa.

As mentioned above, the sight 10 can include a locking assembly to secure the sight element 20 generally in upright position as shown in FIGS. 1-3. This locking assembly can include a plunger 50. This plunger 50 can be movable linearly along a plunger axis PA, and can reciprocate between the positions shown in FIG. 3 and in FIG. 8. When in the position shown in FIG. 3, the plunger is configured in a free mode such that the sight element 20 can move from the upright position to the down position vice versa. When in the position shown in FIG. 8, the plunger is configured in a locking mode such that the sight element is locked in the upright position.

The plunger 50 can be reciprocally slidable in the bore 65 defined by the sight element 20. This bore can be lined with an abrasion resistant, durable and low friction material, such as steel, composites, coatings and the like. The plunger 50 can include a first end 51 and a second end 52. The first end 51 can include threads. A button 70 can include corresponding threads to attach the button 70 to the plunger 50 at the first end 51. In other applications, these two components can be integral with one another. Generally, the button can extend from the first side 21S of the sight element. The button can be manually operable by a user engaging the user's digits against the button to move the plunger from the locking mode to the free mode and vice versa.

The plunger 50 can include a shaft 53 that extends toward the second end 52. The shaft can be sized to fit with minimal tolerance in the bore 65, but still slidable in the bore. The plunger 50 can include a head 50H at the second end 52. The head 50H can be of a polygonal shape. This polygonal shape optionally can be rectangular with rounded off corners. The head can be configured to seat within a recess 25 defined by the side surface 22S of the sight element 20. This recess 25 can be coextensive with the bore 65. The recess 25 also can be similarly shaped as the outer perimeter of the head 50H, optionally to prevent rotation of the plunger relative to the sight element regardless of whether the plunger is in the locking mode or the free mode. For example, the head can interface with the recess 25 so that the head, the shaft, and the button do not rotate relative to the sight element. In some cases, the head 50H can remain at least partially in the sight element recess 25 to prevent such rotation.

Figure 7:
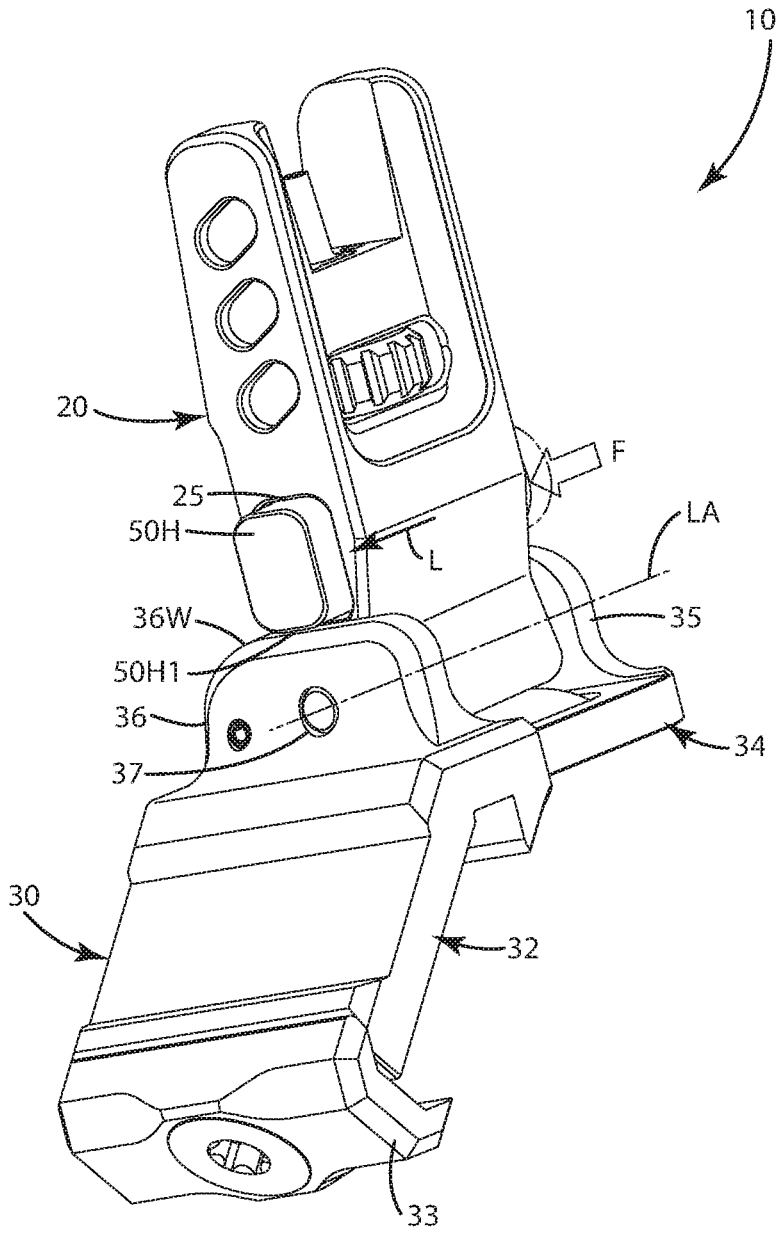
FIG. 7 is a front view of the sight in the upright position held in place by a plunger in a locking mode, and a plunger head engaging a plunger wall.

The plunger can include a head locking surface 50H1, also referred to as an engagement surface. This head locking surface can directly engage one or more walls of the recess, such as the wall 25A, which can generally be aligned with the head locking surface 25H1. The wall and the surface can be substantially planar as illustrated to prevent rotation of the plunger relative to the sight element. The head locking surface 50H1 can be further configured to selectively and directly engage a plunger wall 36W which can form a portion of the upright flange 36. This plunger wall 36W can be an upper edge or an upper portion of the upright flange 36. In other cases, the plunger wall 36W can be a separate wall that extends from some other component of the base 30. The plunger wall 36W can be positioned immediately adjacent the plunger locking surface 50H1 when the sight element 20 is in the upright position as shown in FIGS. 3 and 7.

Optionally, the upright flange 36 also can include an extension stop wall 36S. This extension stop wall 36S can extend generally rearward from the pivot pin 37, toward the rear surface 34B of the offset portion 34. This extension stop wall 36S can extend beyond the rearward most portion 35R of the other upright flange 35, on the opposing side of the sight element 20. This other upright flange 35 can form a recess 35L within which the button 70 rests when the sight element 20 is in the down position as shown in FIG. 5.

Figure 5:
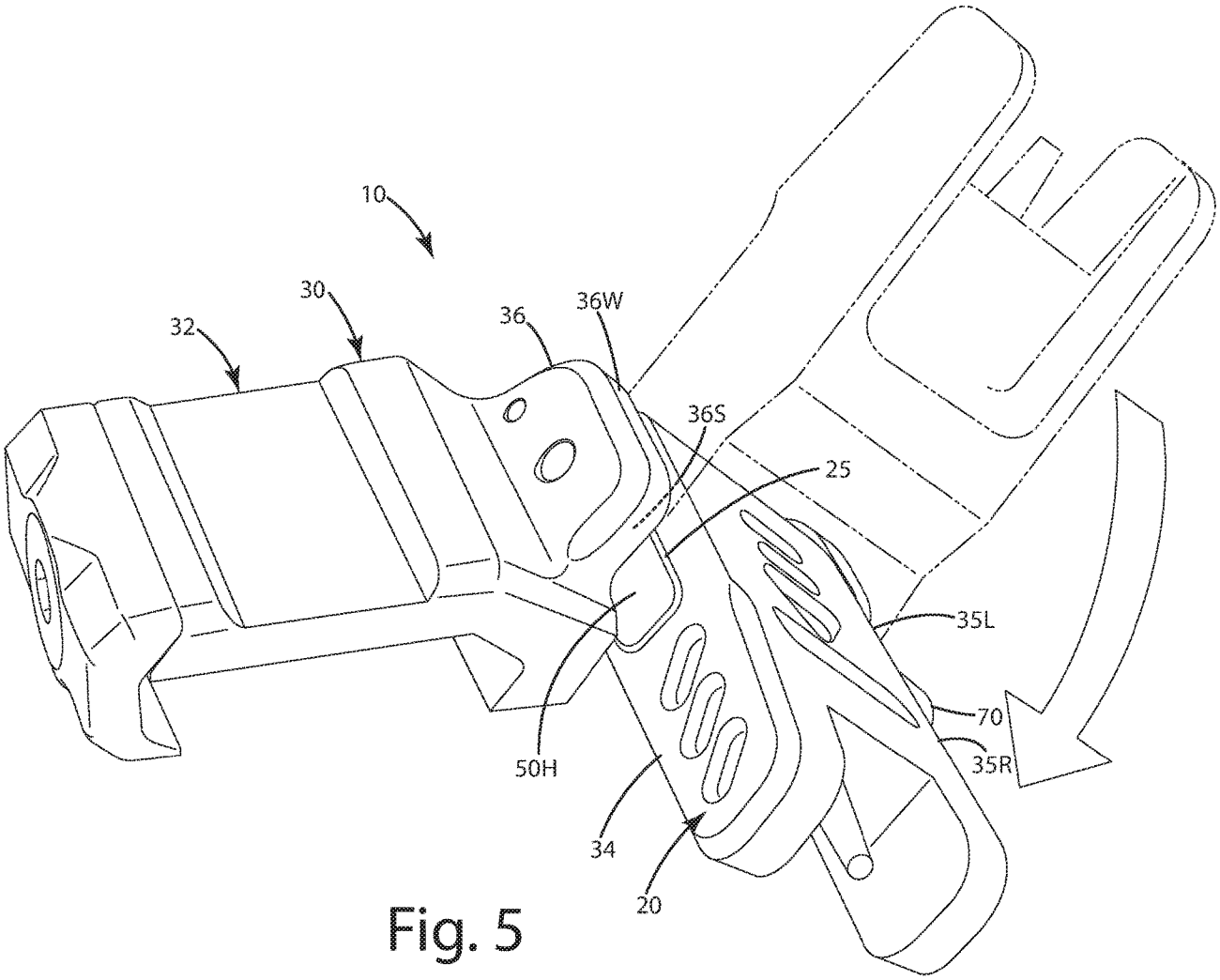
FIG. 5 is a rear view of the sight in a down position, with the plunger in the free mode.

The extension stop wall 36S also can be configured such that when the sight element 20 is in the down position shown in FIG. 5, at least a portion of the head 50H is obstructed by the extension stop wall 36S and a portion of the upright flange 36 in general, so that the head 50H cannot substantially exit the recess 25 defined by the sight element 20. In this manner, the head cannot be deployed from the sight element or generally from the recess 25 when the sight element is in the down position. This can prevent the sight element from being inadvertently locked in the down position.

The plunger 50 also can be configured relative to the sight element 20 in such a manner to hold the plunger and its components in either the lock mode or the free mode. For example, the plunger shaft or some other portion of the plunger can include a detent system 80. This detent system 80 can include a ball 84 adjacent a spring 85 within the sight element, for example, a spring bore of the sight element. The shaft 53 can define a first detent 81 and a second detent 82, each configured to respectively and selectively engage the ball 84. When the plunger 50 is in the free mode shown in FIG. 3, the ball 84 engages the second detent 82 to hold the plunger in that position. When the plunger is pushed or moved to the position shown in FIG. 7, the shaft 53 moves relative to the ball 84. The ball 84 depresses the spring 85. The shaft continues to move until the plunger attains the position shown in the free mode in FIG. 7. There the ball 84 accordingly drops into the first detent 81 thereby locking under spring pressure the plunger shaft in that location with the plunger head in that locking mode.

Operation of the locking system in association with the sight 10 will now be described in more detail. On a high level, the sight 10 can be operated by sliding the plunger 50 in a first direction L as shown in FIG. 7 in a plunger bore 65 defined by the sight element 20. The plunger can be moved under a force F applied by a user to the butt 70 so as to configure the plunger 50 in a locking mode in which the head 50H protrudes from the sight element 20. Thus, upon attempted or inadvertent rotation of the sight element 20 about a pivot axis, for example the longitudinal axis LA, the head 50H, and in particular, the head locking surface 50H1 engages the plunger wall 36W to prevent and/or arrest such rotation. In this manner, the sight is maintained in the substantially upright position.

The plunger 50 alternatively can be moved in a second direction M by the user exerting a force FM (FIG. 8) on the head or otherwise pulling on the button 70. The slides, the plunger shaft in the bore 65, and head 50H into the recess 25 so that the plunger head will not engage the plunger wall 36W. The plunger 50 is thus configured in a free mode. The head 50H thus can clear the plunger wall 36W when the user exerts a rotational force R (FIG. 6) to move the sight element 20 to the down position. When in this down position, the extension stop wall 36S is adjacent the head 50H as shown in FIG. 5. As a result, the extension stop wall 36S prevents the head 50H from being deployed from the sight element 20 and the recess 25 in general. Thus, the sight element 20 can be maintained in the down position, for example, with the bias element 40 engaging the second contour 29C as described above.

Figure 8:
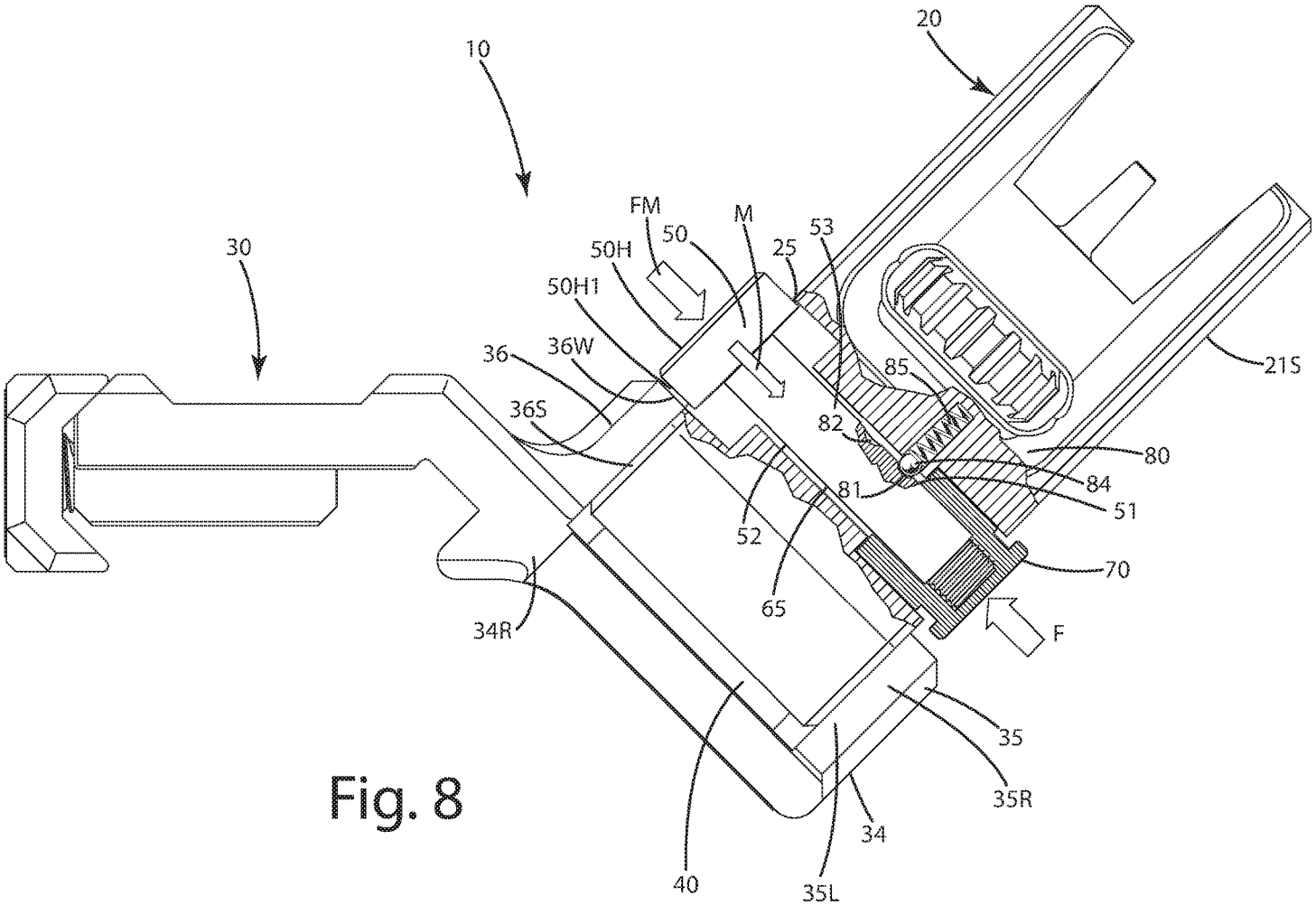
FIG. 8 is a rear partial section view of the sight in the upright position held in place by the plunger in the locking mode, and the plunger head engaging the plunger wall.

As mentioned above, when the plunger 50 moves from the free mode shown in FIG. 3 to the locking mode shown in FIG. 8, the ball 84 can move out of the detent 82 and then into the detent 81 to hold the plunger 50 and the locking mode shown in FIG. 8. When in this locking mode, as noted above, the plunger head 50H can be at least partially or fully disposed in the recess 25.

Further, as mentioned above, when the head 50H is retracted into the recess 25 and the plunger 50H is generally in the free mode, the head 50H can clear the extension stop wall 36S and the plunger wall 36W so that the sight element 20 can be rotated to the down position shown in FIG. 5. Once in this position, the sight element 20 cannot be locked down in this down position. This is because the plunger is prevented from extending to a locking mode via the extension stop wall 36 adjacent and blocking movement of the plunger head.

A user can manipulate the sight 10 of the current embodiments depending on the intended usage of the firearm to which it is attached. For example when a user is utilizing another sight system, such as an optical sight atop the firearm, and only intends to utilize that optical sight, the user can flip the sight element 20 to the down position. When the user intends to engage a target at a long distance and sometimes at a closer distance, where the optical sight might be inferior to the sight 10, the user can flip up the sight element 20. The bias element 40 can maintain the sight element 20 in this upright position. Unless the user deploys the plunger to the locking mode, the sight element 20 can be flipped to the down position again. If the user desires to lock the sight element 20 in the upright position shown for example in FIG. 1, the user can press the plunger under force F and thereby extend the head so that it will engage the plunger wall 36W as described above. The user then can utilize either the optical sight or the sight 10. If the user desires to use the sight 10, the user also can rotate firearm 5 to which the sight 10 is attached about 45° relative to a barrel axis BA shown in FIG. 1 so the sight element 20 is visible in the upright position. To switch back to the optical sight, the user can then rotate the firearm 45° in the opposite direction relative to the barrel axis BA to utilize the optical sight.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A selectively configurable sight for a firearm comprising:

a base including a mounting portion mountable on a firearm rail, the mounting portion including a top surface, a front side, a rear side, opposing lateral sides, a bottom, and a fastener configured for mounting the base to the firearm rail, the base including an offset portion joined with the mounting portion and tilted downward at an angle between 35° and 55° relative to the top surface of the mounting portion, the offset portion including a plunger wall and an extension stop wall;

a sight element pivotally mounted to the offset portion of the base, distal from the mounting portion, the sight element including a first side surface and an opposing second side surface, a front surface and a rear surface with a sight window defined by the sight element, extending from the front surface to the rear surface, the sight element including a lower surface having a first contour, with a second contour disposed on the rear surface, the sight element selectively configurable in an upright position and a down position;

a bias element disposed between the sight element and the offset portion, the bias element configured to engage the first contour and secure the sight element in the upright position, the bias element selectively deformable to enable the sight element to pivot to the down position in which the bias element is configured to engage the second contour and secure the sight element in the down position;

a plunger slidably disposed in a plunger bore defined by the sight element, the plunger including a first end and a second distal end, the second distal end including a head, the plunger being configurable in a locking mode in which the head protrudes from the second side surface such that upon rotation of the sight element about a pivot axis, the head engages the plunger wall to arrest such rotation to thereby maintain the sight element substantially in the upright position, the plunger being configurable in a free mode in which the head is disposed in the second side surface such that upon rotation of the sight element about a pivot axis, the head clears the plunger wall so that the sight element can move to the down position, wherein the extension stop wall is positioned adjacent the head so that the head cannot be deployed from the second side surface to maintain the sight element in the down position, when the sight element is in the down position.

2. The sight of claim 1 comprising:

a button joined with the first end and manually operable to move the plunger from the locking mode to the free mode;

a shaft extending from the first end to the second end at which the shaft is joined with the head;

wherein the button is threadably engaged with the shaft at the first end.

3. The sight of claim 2, wherein the second side defines a recess configured to house the head when the plunger is in the free mode, wherein the head is configured to prevent rotation of the shaft via interfacing with the recess.

4. The sight of claim 3, wherein the shaft includes a first detent and a second detent, the first detent closer to the head than the second detent, wherein a ball is biased against the shaft to engage the first detent when the plunger is in the free mode, wherein the ball is biased against the shaft to engage the second detent when the plunger is in the lock mode.

5. The sight of claim 1, wherein the biasing element is an arched leaf spring.

6. The sight of claim 5, wherein the offset portion includes a recess within which the arched leaf spring is located.

7. The sight of claim 1, wherein the first contour is a first obtusely angled recess, wherein the second contour is a second obtusely angled recess.

8. The sight of claim 7, wherein the biasing element is a leaf spring configured to engage at least two surfaces in the first obtusely angled recess when the sight element is in the upright position, and configured to engage at least two surfaces in the second obtusely angled recess when the sight element is in the down position.

9. The sight of claim 1, wherein the head of the plunger includes a head locking surface, wherein the second side surface defines a recess bounded a wall, wherein the head locking surface engages the wall to prevent rotation of the plunger relative to the sight element.

10. A selectively configurable sight for a firearm comprising:

a base including a mounting portion mountable on a firearm rail, and an offset portion integral with and tilted downward at an angle of about 45° relative to the mounting portion, the offset portion including plunger wall immovably integrated with the offset portion;

a sight element pivotally mounted to the offset portion of the base, distal from the mounting portion, the sight element including a first side surface and an opposing second side surface, a front surface and a rear surface with a sight window defined by the sight element, extending from the front surface to the rear surface, the sight element selectively configurable in an upright position and a down position;

a plunger slidably disposed in a plunger bore defined by the sight element, the plunger including a first end and a second end, the second end including a head, the plunger being configurable in a locking mode in which the head protrudes from the second side surface to prevent substantial rotation of the sight element about a pivot axis to thereby maintain the sight element substantially in the upright position, the plunger being configurable in a free mode in which the head is retracted into the second side surface so the head clears the plunger wall and the sight element can move to the down position, wherein the extension stop wall is adjacent the head so that the head cannot be deployed from the second side surface to maintain the sight element in the down position when the sight element is in the down position.

11. The sight of claim 10 comprising:

a bias element disposed between the sight element and the offset portion, the bias element configured to engage a first contour on a lower surface of the sight element and secure the sight element in the upright position, the bias element selectively deformable to enable the sight element to pivot to the down position.

12. The sight of claim 11, wherein the bias element is configured to engage a second contour on the rear surface and secure the sight element in the down position.

13. The sight of claim 10 comprising:

a button joined with the first end and manually operable to move the plunger from the locking mode to the free mode;

a shaft extending from the first end to the second end at which the shaft is joined with the head;

wherein the button is manually engageable on the first side and the head is manually engageable on the second side so that the plunger can be manipulated to at least one of the free mode and the locking mode from either the first or second sides of the sight element.

14. The sight of claim 10, wherein the second side defines a recess configured to house the head when the plunger is in the free mode, wherein the head is configured to prevent rotation of the shaft via interfacing with the recess.

15. The sight of claim 14, wherein the head is a polygonal shape and the recess is the same polygonal shape.

16. The sight of claim 10, wherein the plunger includes a shaft having a first detent and a second detent, the first detent closer to the head than the second detent, wherein a ball is biased against the shaft to engage the first detent when the plunger is in the free mode, wherein the ball is biased against the shaft to engage the second detent when the plunger is in the lock mode.

17. The sight of claim 10, wherein the sight element is held in the upright position via an arched leaf spring pushing against a lower contoured surface of the sight element, the arched leaf spring located in the offset portion.

18. The sight of claim 10, wherein the offset portion includes an offset base defining a recess in which a leaf spring is biased against a lower surface of the sight element to secure the sight element in the upright position, wherein the plunger wall extends rearward from a rear surface of the sight element adjacent the leaf spring, wherein a pivot pin extends through the plunger wall and the sight element and an opposing distal wall joined with the offset base, wherein the pivot pin is located above the leaf spring.

19. A method of selectively configuring a sight comprising:

providing a base including a mounting portion configured to mount on a firearm rail, and an offset portion integral with and tilted downward at an angle relative to the mounting portion, the base including plunger wall and an extension stop wall;

sliding a plunger in a first direction in a plunger bore in a second side defined by a sight element, the plunger including a first end and a second end, the second end including a head, so as to configure the plunger in a locking mode in which the head protrudes from the sight element such that upon rotation of the sight element about a pivot axis, the head engages the plunger wall to arrest such rotation to thereby maintain the sight element substantially in the upright position, sliding the plunger in a second direction, opposite the first direction, in the plunger bore so as to configure the plunger in a free mode in which the head is retracted into the sight element so the head clears the plunger wall and the sight element can move to the down position, wherein the extension stop wall is adjacent the head in the down position so that the head cannot be deployed from the second side surface to maintain the sight element in the down position when the sight element is in the down position.

20. The method of claim 19, comprising:

rotating a firearm to which the sight is attached about 45 degrees relative to a barrel axis of the firearm to aim the firearm utilizing the sight element in the upright position.

* * * * *